US006050786A

United States Patent [19]

Lin

[11] Patent Number: 6,050,786

[45] Date of Patent: Apr. 18, 2000

[54] HEAT DISSIPATION STRUCTURE OF A FAN UNIT

[75] Inventor: Kuo-Cheng Lin, Taoyan Shien, Taiwan

[73] Assignee: Delta Electronics, Inc., Taoyan Shien, Taiwan

[21] Appl. No.: 09/136,286

[22] Filed: Aug. 19, 1998

[51] Int. Cl.[7] ..... F04B 17/00

[52] U.S. Cl. ..... 417/366; 417/423.8; 417/423.12

[58] Field of Search ..... 417/366, 271, 417/372, 423.8, 423.12, 423.1, 354

[56] References Cited

U.S. PATENT DOCUMENTS

| | | | |
|---|---|---|---|
| 3,644,066 | 2/1972 | Heob et al. | 417/354 |
| 5,340,291 | 8/1994 | Benckert et al. | 417/569 |
| 5,584,675 | 12/1996 | Steurer et al. | 417/372 |
| 5,957,667 | 9/1999 | Epp | 417/271 |

*Primary Examiner*—Teresa Walberg
*Assistant Examiner*—Jeffrey Pwu
*Attorney, Agent, or Firm*—Bacon & Thomas

[57] ABSTRACT

A heat dissipation structure of a heat-dissipating box fan is disclosed. The structure is used for dissipating the heat generated by the motor of the fan unit. The structure has a bearing sleeve that comprises a hub in the form of a generally hollow cylindrical column and a sleeve base. The hub is inserted inside a central through hole of the fan motor, and the sleeve base covers the base of the plastic frame of the fan unit at the end of the frame opposing the other with the motor installed. A number of heat dissipation fins are formed over the lateral peripheral surface of the base of the bearing sleeve. The hub of the bearing sleeve has a hollow column shape of a polygonal peripheral configuration at the end close to the base and a hollow column shape of a cylindrical configuration for the remaining section thereof.

6 Claims, 4 Drawing Sheets

HEAT DISSIPATION STRUCTURE OF A FAN UNIT

BACKGROUND OF THE INVENTION

1. Field of the Invention

This invention relates in general to a heat dissipation structure, and in particular to a heat dissipation structure for a heat-dissipating fan unit.

2. Description of Related Art

Conventional heat dissipation structures for box fan units can be generally categorized into two groups. One group of these heat to dissipation structures has plastic frameworks with copper linings. The other group has metallic frameworks made of metals such as aluminum.

Frames for a fan unit with copper lining is low in cost, light in weight and features electrically insulating body, which is advantageous in preventing short-circuiting in the environment of printed circuit boards (PCB). However, its plastic frame is also thermally insulating that the heat generated by the fan rotor bearing accumulates. This is because the copper lining is totally enclosed by the plastic. This heat accumulation in the fan motor increases the motor operating temperature and reduces the motor life expectancy. Thus, copper lining plastic fans are only suitable for applications with slow fan speeds and low fan motor power ratings. This prevents damage to the fan motor as low-power and slow-speed motor operation allows to keep the motor operating temperature reasonably low. Due to this power and speed limitation, copper lining plastic fans are limited in their possible applications.

To overcome this limitation, metallic materials such as aluminum or its alloy is used to construct the framework for heat dissipation fans. A metal frame for heat dissipation fans is efficient in thermal conduction, it is capable of effectively dissipating heat generated in the fan motor, including heat generated in the motor bearing. A fan motor can thus be maintained at low operating temperature, which allows the fanned heat dissipation unit to enjoy its life expectancy. However, a metallic frame for these fanned heat dissipation units costs relatively higher and is commercially less competitive than its plastic counterpart. Meanwhile, in addition to being weighting much heavier, a metallic frame is also potentially dangerous in the PCB environment as it may cause short-circuiting among the components of the PCB since it is itself electrically conductive.

SUMMARY OF THE INVENTION

It is therefore an object of the invention to provide a heat dissipation structure for fan units that is efficient in heat dissipation.

It is another object of the invention to provide a heat dissipation structure for fan units that is light in weight.

It is yet another object of the invention to provide a heat dissipation structure for fan units that is low in cost.

It is still another object of the invention to provide a heat dissipation structure that is electrically non-conductive to prevent short-circuiting in the PCB environment.

The present invention achieves the above-identified objects by providing a heat dissipation structure of a heat-dissipating box fan. The structure is used for dissipating the heat generated by the motor of the fan unit. The structure has a bearing sleeve that comprises a hub in the form of a generally hollow cylindrical column and a sleeve base. The hub is inserted inside a central through hole of the fan motor, and the sleeve base covers the base of the plastic frame of the fan unit at the end of the frame opposing the other with the motor installed. A number of heat dissipation fins are formed over the lateral peripheral surface of the base of the bearing sleeve. The hub of the bearing sleeve has a hollow column shape of a polygonal peripheral configuration at the end close to the base and a hollow column shape of a cylindrical configuration for the remaining section thereof.

BRIEF DESCRIPTION OF THE DRAWINGS

Other objects, features, and advantages of the invention will become apparent by way of the following detailed description of the preferred but non-limiting embodiments. The description is made with reference to the accompanying drawings in which.

DESCRIPTION OF THE PREFERRED EMBODIMENT

Figure 1:
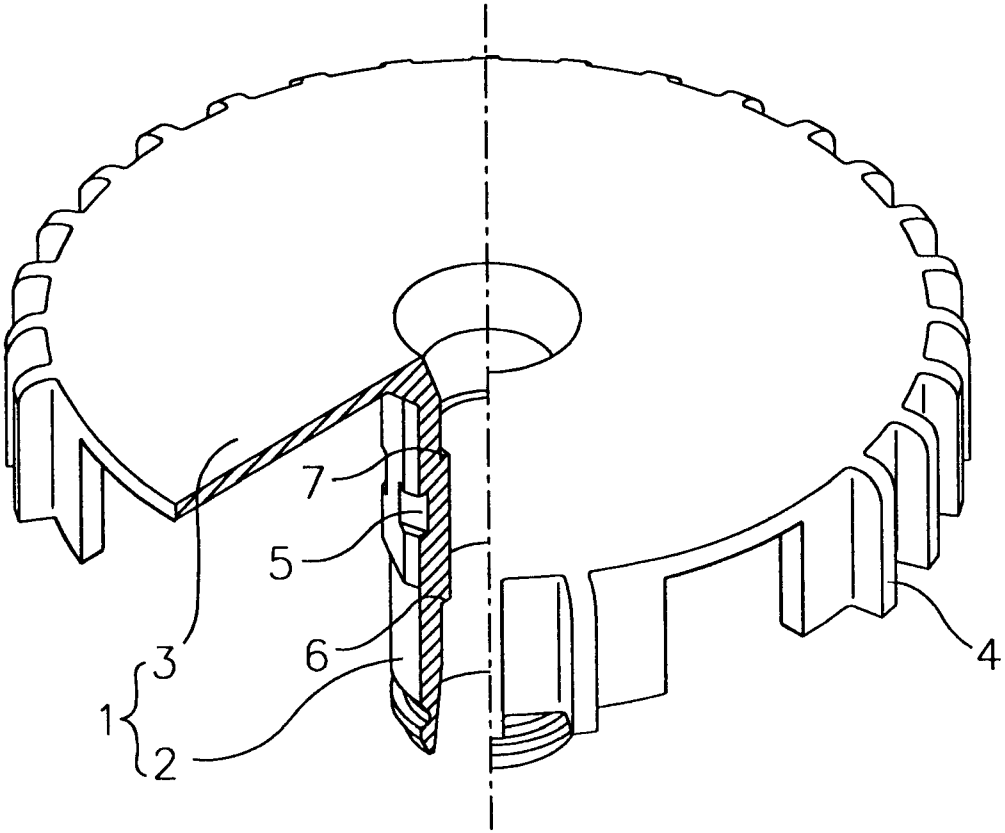
FIG. 1 is a partially cut-away perspective view of a preferred embodiment of the heat dissipation structure of the invention.
Figure 2:
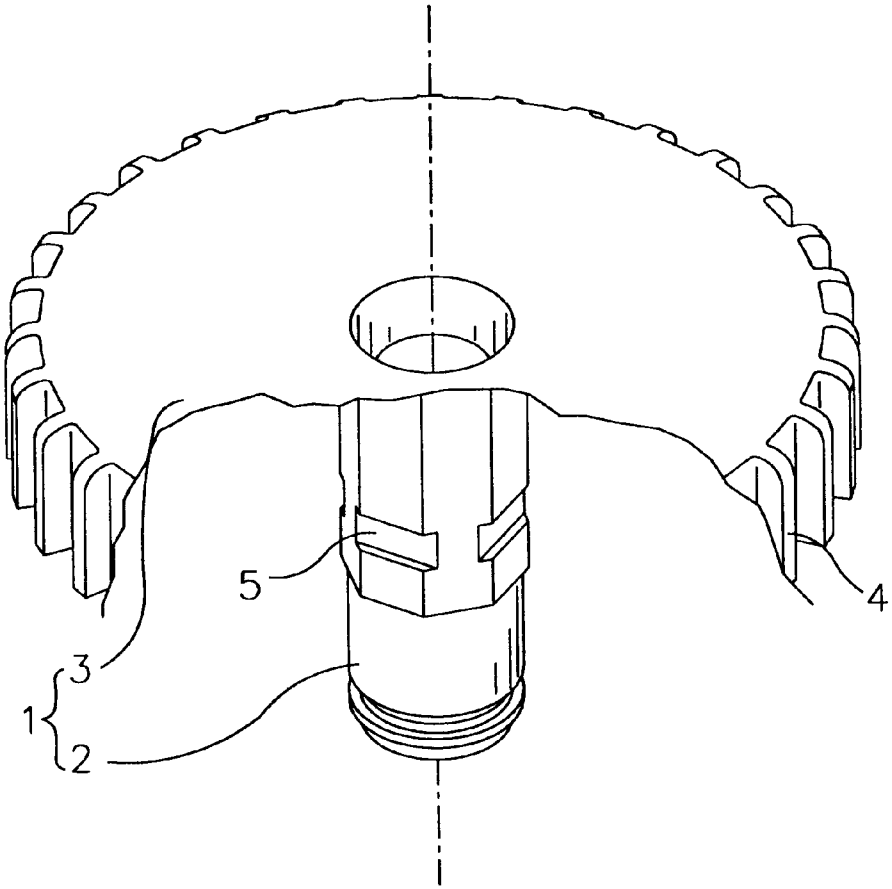
FIG. 2 is another partially cut-away perspective view of the preferred embodiment of the heat dissipation structure of the invention.

Refer to FIGS. 1 and 2 simultaneously. FIGS. 1 and 2 shows the partially cut-away perspective view of a preferred embodiment of the heat dissipation structure for box fan units of the invention. As is shown in the drawing, the heat dissipation structure of the invention is comprised of a body integrally-formed, for example, of a zinc-aluminum alloy. The structural body has a bearing sleeve 1 and a number of heat dissipating protrusions such as fins 4. The heat dissipation fins may be formed integrally with the sleeve itself, or they may be formed by assembling discrete components together.

The bearing sleeve 1 includes a base 3 and a hub 2 generally shaped as a hollow cylindrical column. The section of the hub 2 proximate to the end of the base 3 has a polygonal peripheral configuration of, for example, a octagonal column, as is better shown in FIG. 2. The rest of the length of the hub 2 may generally remain to be the shape of a simple hollow cylindrical column. Over the external peripheral surface of the octagonal section of the hub 2, a number of snapping engagement notches 5 are formed. Over the internal peripheral surface of the hollow space inside the hub 2, annular stepped recess flanges 6 and 7 are formed.

Figure 4:
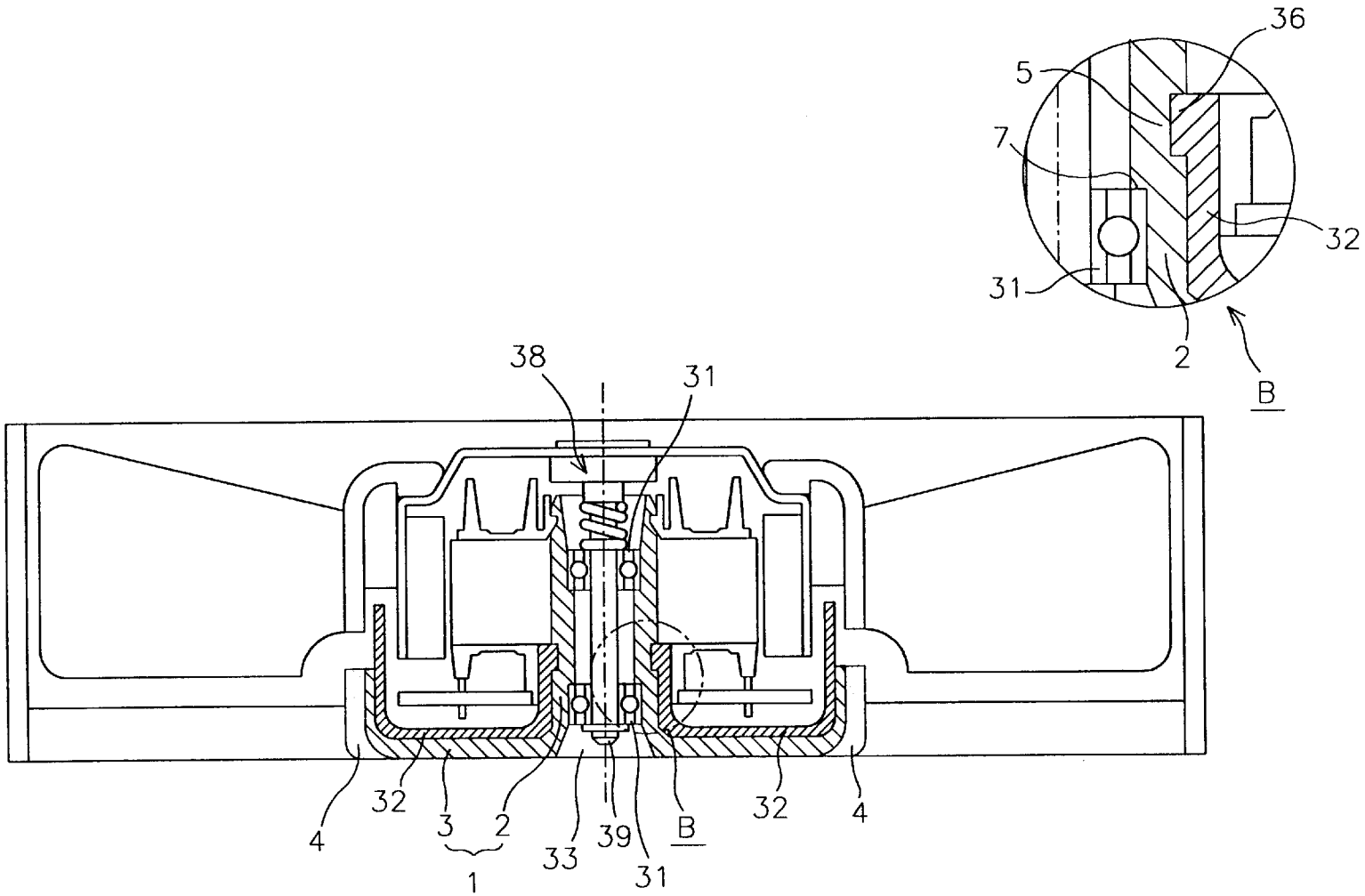
FIG. 4 is the cross-sectional view of the fan unit taken along the AA line of FIG. 3.

In an application as a box fan unit utilizing the heat dissipation structure of the preferred embodiment as depicted in FIGS. 1 and 2, a motor can be assembled to the structure. As is illustrated in the cross-sectional view of FIG. 4, hub 2 of the bearing sleeve 1 can be inserted into the central through hole 33 of the fan motor. As the hub 2 is inserted into the through hole 33, the snapping engagement protrusions 36 formed on the inner peripheral surface of the base 32 of the fan unit plastic framework can be snappingly engaged with the notches 5 of the hub 2. This engagement, which is detailed in the enlarged view B of FIG. 4, is capable of securing the bearing sleeve 1 to the fan unit framework. Base 3 of the bearing sleeve 1 covers the base 32 of the fan unit plastic framework.

Figure 3:
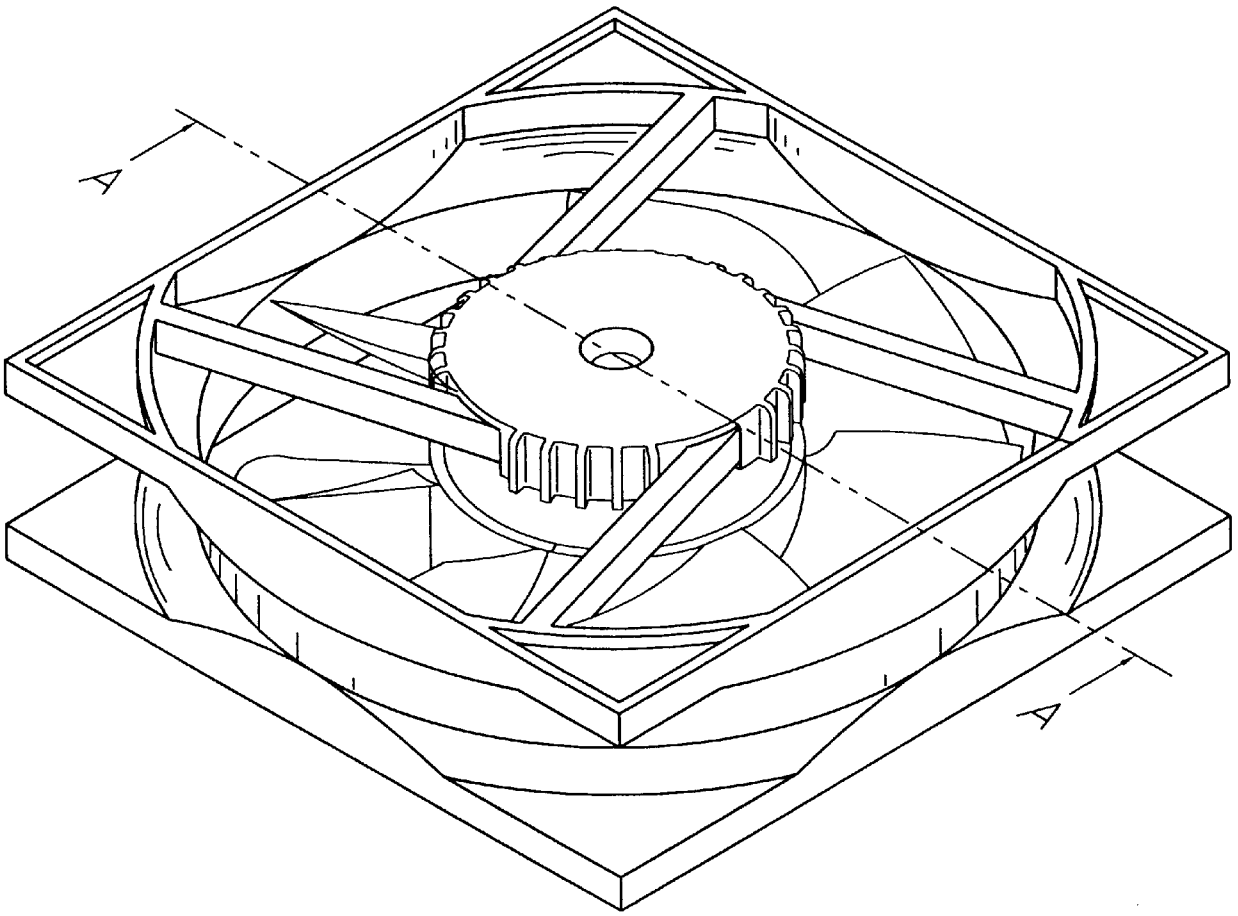
FIG. 3 is a perspective view showing the heat dissipation structure of the invention when assembled as a complete fan unit together with a motor and a fan blade.

When the hub 2 is inserted properly into the central through hole 33 of the fan motor, two bearing 31 can be installed inside the central hollow space of the hub 2 close to the opening of the two opposite ends of the central through hole 33. Each of the two bearings 31 can be pressed toward the center of the hub hollow space and butting against the stepped annular flanges 6 and 7 respectively. Flanges 6 and 7 serve to prevent both bearings 31 from reaching to each other inside the through hole 33. Then, a fan blade rotor shaft 39 of the fan assembly 38 for the fan unit can be inserted inside the central through hole 33, with the rotor shaft 39 properly received by the two bearings 31. FIG. 3 shows the perspective view of a heat-dissipating fan unit employing the heat dissipation structure of the invention when assembled as a complete box fan unit together with a motor and a fan blade.

When the fan unit operates and the fan motor spins, the heat generated by the bearings 31 can be conducted via the hub 2 of the bearing sleeve 1, and then to the heat-dissipation fins 4 formed over the surface of the base 3. The bearing heat can thus be dissipated efficiently in the air flow generated by the fan assembly 38 as it is driven to rotate by the fan motor. Since the bearing sleeve 1 extends from within the central through hole 33 to the base 32 of the fan unit plastic framework, it allows the fan motor to enjoy a much larger heat-dissipating surface area than the conventional designs with only the copper lining confined within the internal space of the central through hole 33, about the internal proximity of the motor.

Thus, box fans employing the heat dissipation structure of the invention can have a better heat dissipation efficiency, and the heat generated by the bearings 31 can be easily removed from the unit. This means motor heat of the fan unit does not accumulate inside the unit, in particular, as the inventive structure has the heat dissipation fins 4 installed.

Further, the framework of the box fan unit employing the heat dissipation structure of the invention can still be made of plastic material. When compared with the conventional structure, the heat dissipation structure of the invention achieves comparable heat dissipation capacity as that constructed out of a full metal framework. This is achieved by covering a portion of the plastic framework with a thermal conducting metal structure having heat dissipation fins. This reduces cost of the framework relative to that of a full metal one. Electric short circuiting is also preventable with the heat dissipating structure of the invention.

While the invention has been described by way of example and in terms of preferred embodiment, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A heat dissipation structure of a heat-dissipating fan unit for dissipating the heat generated by the motor of the fan unit comprising:

a bearing sleeve comprising a hub in the form of a generally hollow cylindrical column and a sleeve base, the hub is inserted inside a central through hole of the fan motor, and the sleeve base covers the base of the plastic frame of the fan unit at the end of the frame with the motor installed;

a plurality of heat dissipation fins formed over the lateral peripheral surface of the base of the bearing sleeve; and wherein the hub of the bearing sleeve having a hollow column shape of a polygonal peripheral configuration at the end close to the base and a hollow column shape of a cylindrical configuration for the remaining section thereof.

2. The heat dissipation structure of claim 1, wherein two annular stepped recess flanges are formed over the internal peripheral surface of the hollow space inside the hub, each of the flanges receives a bearing for the rotor shaft of the fan motor and preventing the two bearings from reaching to each other inside the central through hole.

3. The heat dissipation structure of claim 1 or 2, wherein a plurality of snapping engagement notches are formed over the external peripheral surface of the polygonal section of the hub, each of the notches engages with a corresponding one of a plurality of snapping engagement protrusions formed on the inner peripheral surface of the base of the fan unit plastic framework, and the engagement is capable of securing the bearing sleeve to the fan unit framework.

4. The heat dissipation structure of claim 1, wherein the bearing sleeve and the plurality of heat dissipation fins are formed integrally.

5. The heat dissipation structure of claim 1, wherein the bearing sleeve and the plurality of heat dissipation fins are formed by assembling discrete components together.

6. The heat dissipation structure of claim 1, wherein the bearing sleeve and the plurality of heat dissipation fins are formed of metallic material.

* * * * *